US010669128B2

(12) United States Patent
Robbins-Capuano et al.

(10) Patent No.: US 10,669,128 B2
(45) Date of Patent: Jun. 2, 2020

(54) SMART PIT FOR HYDRAULIC ELEVATORS AND OTHER PRODUCTS USING PRESSURIZED HYDRAULIC FLUIDS

(71) Applicant: W2W 777 Operations, LLC, Morganville, NJ (US)

(72) Inventors: Barry Robbins-Capuano, Seguin, TX (US); Jerome Fokas, Cliffwood, NJ (US)

(73) Assignee: W2W 777 Operations, LLC, Morganville, NJ (US)

( * ) Notice: Subject to any disclaimer, the term of this patent is extended or adjusted under 35 U.S.C. 154(b) by 234 days.

(21) Appl. No.: 15/564,331

(22) PCT Filed: Apr. 4, 2016

(86) PCT No.: PCT/US2016/025825
§ 371 (c)(1),
(2) Date: Oct. 4, 2017

(87) PCT Pub. No.: WO2016/164290
PCT Pub. Date: Oct. 13, 2016

(65) Prior Publication Data

US 2018/0141782 A1 May 24, 2018

Related U.S. Application Data

(60) Provisional application No. 62/144,532, filed on Apr. 8, 2015.

(51) Int. Cl.
*B66B 9/04* (2006.01)
*B66B 1/04* (2006.01)
(Continued)

(52) U.S. Cl.
CPC ..... *B66B 9/04* (2013.01); *B66B 1/04* (2013.01); *B66B 5/0018* (2013.01); *B66B 5/0025* (2013.01); *B66B 5/028* (2013.01)

(58) Field of Classification Search
CPC ..... B66B 9/04; B66B 1/04; B66B 5/0018; B66B 5/028
See application file for complete search history.

(56) References Cited

U.S. PATENT DOCUMENTS 3,183,669 A * 5/1965 McGuire ..... F15B 21/00 60/455
3,741,075 A * 6/1973 Moseley ..... B66B 5/028 91/451
(Continued)

*Primary Examiner* — Michael A Riegelman
(74) *Attorney, Agent, or Firm* — Abelman, Frayne & Schwab

(57) ABSTRACT

A system controls leakage in a pit which contains equipment which uses pressurized hydraulic fluid. A tap communicates with a space holding leaked fluid, and directs leaked fluid to a fluid sump. A pump moves fluid from the fluid sump to a hydraulic fluid recapturing holding tank located outside the pit above a fluid reservoir. Fluid from the fluid reservoir is selectively relocated into the fluid reservoir, which re-supplies the equipment. An electronic control panel located outside the pit interacts with a remote computer to provide a remote user with information concerning operation of the system and to allow the remote user to monitor and control at least certain operations of the system, and which processor also controls operation of the pump and actuating valve. All of the mechanical and electrical equipment of the system is located outside of the pit.

17 Claims, 2 Drawing Sheets

(51) Int. Cl.
*B66B 5/00* (2006.01)
*B66B 5/02* (2006.01)

(56) References Cited

U.S. PATENT DOCUMENTS

| | | | | | |
|---|---|---|---|---|---|
| 4,463,663 | A * | 8/1984 | Hanson, Jr. | F15B 15/1433 | 92/80 |
| 6,374,723 | B1 * | 4/2002 | Cook | F15B 15/1428 | 92/86 |
| 6,435,310 | B1 * | 8/2002 | Choi | B66B 9/04 | 187/275 |
| 6,505,711 | B1 * | 1/2003 | Zurcher | B66B 1/24 | 187/275 |
| 7,004,062 | B2 * | 2/2006 | Paduano | B66B 9/04 | 60/455 |
| 2002/0153204 | A1 * | 10/2002 | Veletovac | B66B 1/24 | 187/275 |
| 2003/0173159 | A1 * | 9/2003 | Moser | B66B 9/04 | 187/285 |
| 2004/0074702 | A1 * | 4/2004 | Moser | B66B 9/04 | 187/275 |
| 2011/0108370 | A1 * | 5/2011 | Therriault | B66B 5/0006 | 187/393 |
| 2013/0333982 | A1 * | 12/2013 | Haapaniemi | B66B 5/0031 | 187/275 |
| 2014/0158469 | A1 * | 6/2014 | Bisig | B66B 1/24 | 187/285 |
| 2014/0174860 | A1 * | 6/2014 | Yakuel | B66B 17/12 | 187/272 |
| 2015/0375962 | A1 * | 12/2015 | Hamlett | B66B 5/022 | 187/247 |

* cited by examiner

SMART PIT FOR HYDRAULIC ELEVATORS AND OTHER PRODUCTS USING PRESSURIZED HYDRAULIC FLUIDS

CROSS REFERENCE TO RELATED APPLICATIONS

The present application is a national phase of PCT application No. PCT/US2016/025825, filed Apr. 4, 2016, which claims priority on U.S. provisional patent application No. 62/144,532, filed on Apr. 8, 2015, all of which are incorporated herein by reference thereto.

BACKGROUND OF THE INVENTION

The Invention relates to the control of hydraulic fluid spills on to a pit floor, the containment of leaked hydraulic fluid, and the monitoring and recycling of such spilled hydraulic fluid.

Wet product or spills on smooth floors or walking surfaces present both safety and environmental concerns, especially if the liquid on such a floor or surface is oil or other hydraulic fluid. Unfortunately, oil and/or other hydraulic fluid leaks and spills are common occurrences in elevator shafts and often present such environmental and safety issues when they occur.

Governmental agencies including the federal EPA, its state counterparts, and OSHA, regulate how leaks and spills are to be handled. In addition to worker safety, these agencies (especially those that regulate environmental protection) seek to ensure that any leaked or spilled oil or other hydraulic fluid that is spilled or leaked onto an elevator pit floor does not enter a storm drain or other reservoir which will result in contamination of ground water, streams or other bodies of water.

There is currently a need for a better system to address the problems associated with leaks and spills of hydraulic fluids, including oil, in elevator shafts and other environments where such fluids could leak into surrounding areas causing contamination.

FIG. 1 depicts a conventional hydraulic elevator of the type widely used in low rise applications such as hotels, motels, shopping centers, office buildings, and hospitals. In FIG. 1, the elevator shaft is cut vertically in half to reveal the inner workings of the hydraulic operations. An elevator car 10 is disposed in a shaft 12 and guided for vertical movement by rollers 14. The car 10 is supported on a piston 16, the lower end of which is disposed in a hydraulic cylinder 18. A pump 20 selectively pumps hydraulic fluid from a reservoir 22 into the interior 24 of the cylinder 18 to raise the car 10, and vents fluid from the interior 24 back to the reservoir 22 to lower the car. As the hydraulic fluid is either inserted into or withdrawn from the cylinder interior 24, the piston will either be pushed up, to raise the elevator car, or be lowered downward, to lower the car.

The piston 16 moves the car 16 between floors, one of which is shown for simplicity. Each floor has at least one door 26. The car 10 has at least one car door 28, which is selectively opened and closed by a door operator 30. Typically, the mechanism which opens and closes the car door or doors 28 interacts with the floor door or doors 26 to open and close the floor doors 26 simultaneously with the car doors 28. A pair of hallway call buttons 32, enabling a passenger to select a desired direction of movement, i.e., "up" and "down," are provided at each door 26 so that passengers can call for the car 10 to pick them up. Finally, the elevator includes a pair of buffers 34 located in the elevator pit 36 to stop the car 10 from hitting the pit floor 37 in the event the hydraulic lift mechanism 16, 18, 20 fails.

The piston 16 is located in the center of the cylinder 18 and rubber bushings 40 are located at the top of the cylinder between the inside surface of the cylinder and the outside surface of the piston to form a seal.

A car controller 42 controls the general operation of the elevator car 10. The controller 42 is coupled electronically to the call buttons 32 to receive requests to send the car 10 to the corresponding floor. The controller 42 also monitors floor buttons inside the elevator car 10 in which passengers enter the number of the desired floor. The controller 42 also controls the movement of the car 10 as it travels to the requested floor. Once the controller 42 senses that the car 10 has reached the requested floor, the controller 42 releases the car into the control of the door operator 30 which controls the opening and closing of the door 28 and, when completed, releases the car 10 back into the control of the car controller 42. Finally, if the car is one in a bank of multiple elevators, a group controller may be provided, which determines which elevator in the bank should respond to an elevator car call request.

There can also be signals, such as an arrival light and bell adjacent to the doors to indicate that a car has arrived and its direction of travel. Preferably, the elevator includes known safety equipment such as sensors in the door openings.

As the piston 16 is elevated the rubber bushings 40 remove almost all of the hydraulic fluid; however a very thin layer is left to remain as an operational lubricant. As the piston 16 is lowered the rubber bushing shears off a small portion of the hydraulic fluid. Over time and with continued use this very small portion begins to build up and is left resting on top of the elevator cylinder 18. Eventually this build up increases to such a point where the fluid begins to run down from the top of the elevator cylinder to the elevator pit floor 37.

Depending on the frequency of use of the elevator, the rubber bushings will deteriorate over time and the amount of hydraulic lubricant build up and leaking will increase to a point where oil or other fluids can spill onto the pit floor. This process is rarely monitored and typically not documented, which can result in a slippery pit floor.

Based on our observation of the industry, it appears that the typical manner by which this issue is addressed is through the use of a non-fire rated plastic five gallon bucket to collect the hydraulic fluid that leaks from the elevator shaft. Needless to say, this rudimentary "fix" does not adequately address the safety and environmental concerns presented from leaking and spilling hydraulic fluids. To the contrary, depending on how the fluid collected in those buckets is disposed, this common practice may actually contribute to even greater safety concerns and environmental harm.

SUMMARY OF THE INVENTION

We begin with the approach that to address a problem one must first recognize the problem. The invention recognizes that fluid leakage in a hydraulic elevator is problematic, and is designed to monitor the leakage and remedy the problem when appropriate.

The invention captures and stores in a sump excessive hydraulic fluid which would otherwise leak into the pit and monitors the amount of hydraulic fluid captured before it becomes a full leak. The invention also at appropriate times pumps the captured fluid to a holding tank which is connected for returning the fluid back to the main hydraulic fluid reservoir for the elevator. An actuating valve is normally closed to keep hydraulic fluid in the holding tank, and an electronic float or other monitoring device monitors the amount of recaptured fluid in the holding tank, and provides signals representing such amount to an electronic control panel. When the amount of fluid reaches a predetermined amount, the electronic control panel opens the actuating valve to allow recaptured fluid to return to the main reservoir.

The upper end of the cylinder is typically capped by a cylinder cap. Fluid that leaks through the bushing flows into the cylinder cap. To remove such fluid, the cylinder cap is tapped into for the purpose of collecting excess hydraulic fluid and directing the fluid into a sealed collection cylinder located below the elevator pit floor. To facilitate flow, the upper end of the cylinder cap is provided with a vacuum vent check valve.

Through the use of an air pressure sensor monitor, once the fluid reaches a particular level, that information is relayed to the control panel. Once alerted, the control panel will direct the removal of the excess fluid from the collection cylinder by utilizing a self-priming pump located outside the elevator pit and sending it to a temporary holding reservoir located above the elevator hydraulic fluid holding tank in the mechanical room. An electronic float in the temporary holding reservoir will notify the control panel once the temporary holding tank becomes full. At that time the control panel will open a release valve, pouring the fluid back into the original hydraulic fluid holding tank, thus completely recycling the hydraulic fluid. The amount and regularity of the foregoing actions will be monitored by the control panel and communicated by way of Ethernet communication to the party responsible for maintaining elevator operations.

DETAILED DESCRIPTION OF THE INVENTION

Figure 1:
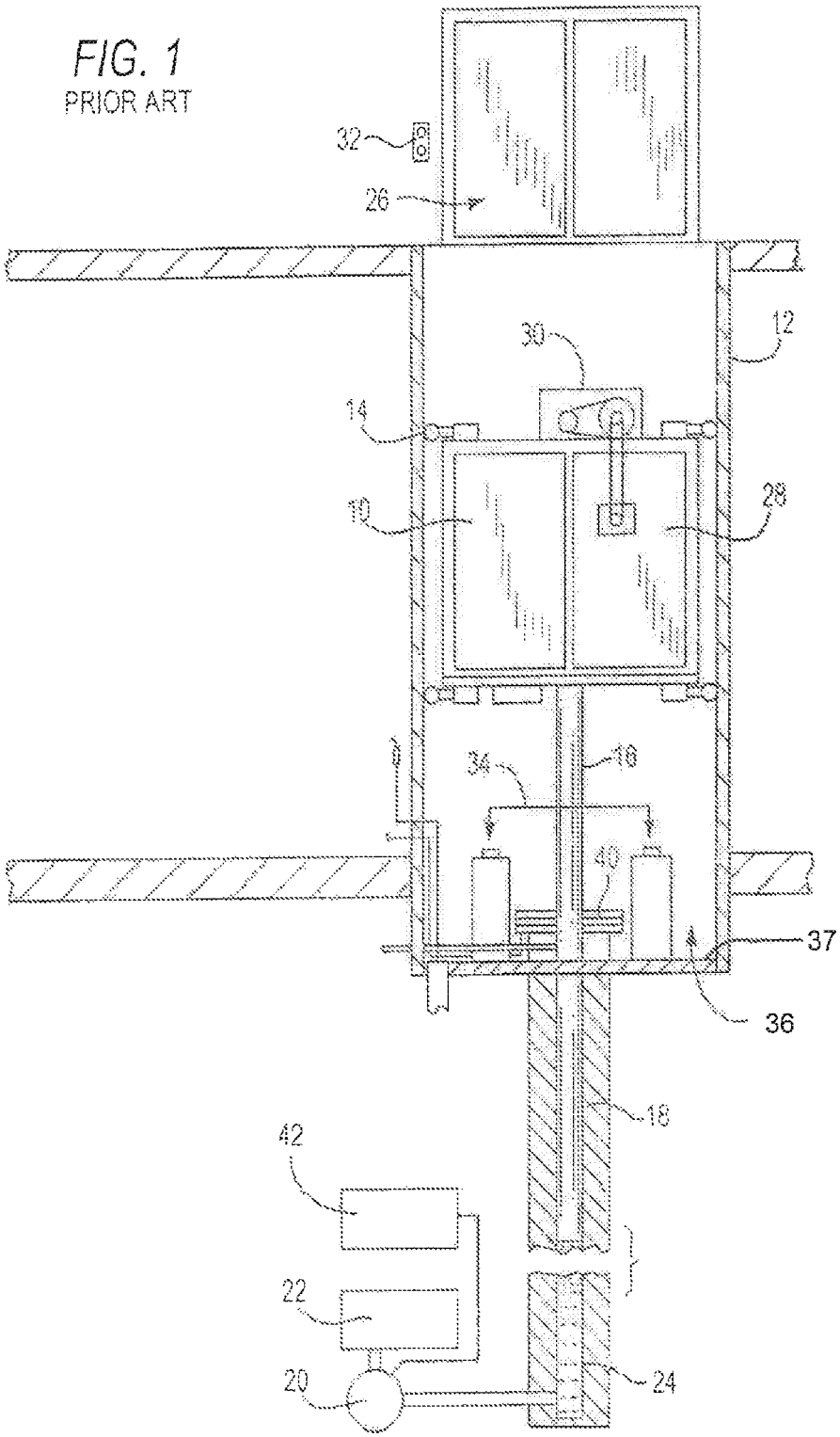
FIG. 1 PRIOR ART
FIG. 1 is a side, sectional view of a conventional hydraulic elevator.
Figure 2:
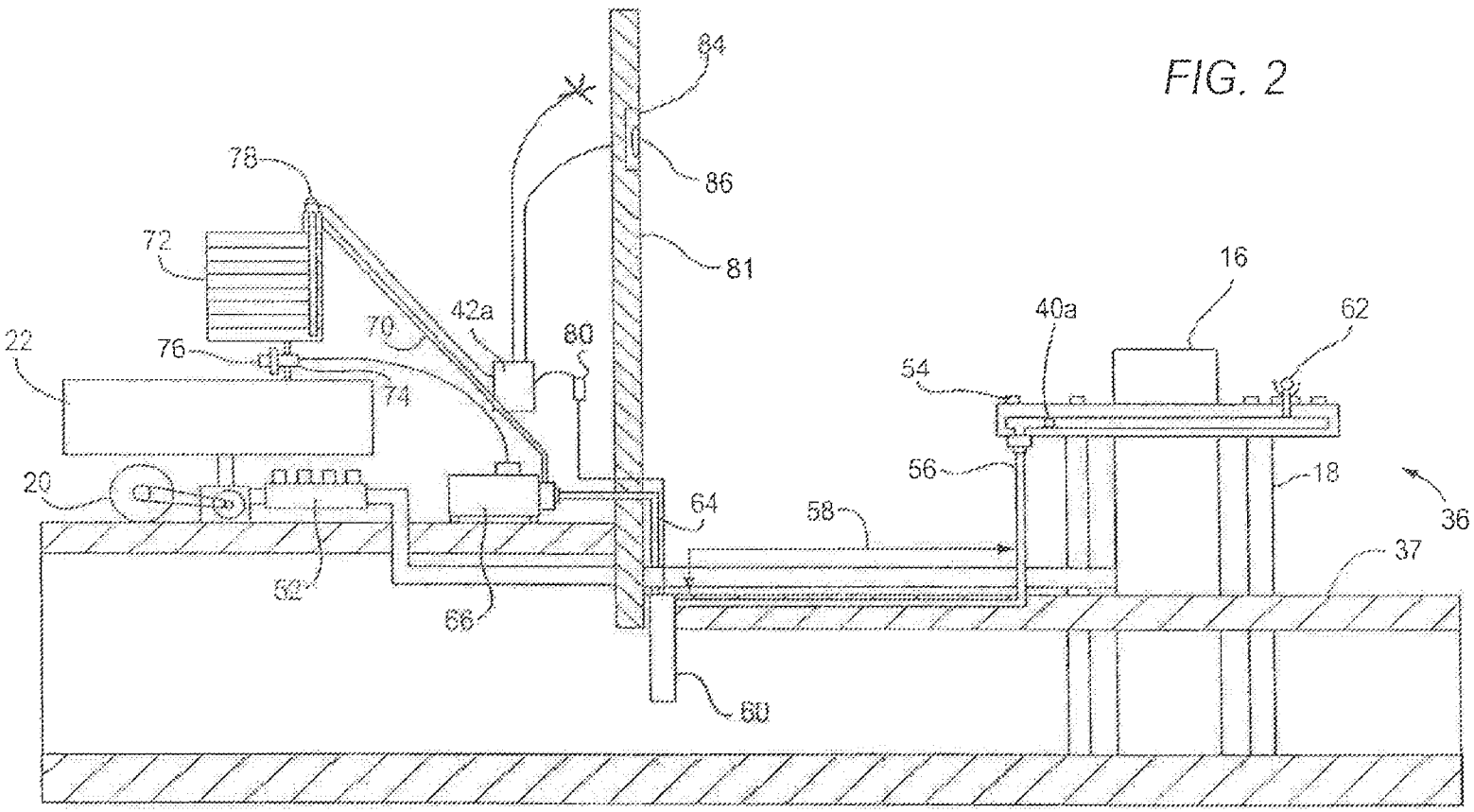
FIG. 2 is a side, sectional view of an embodiment of the present invention which may be used with the elevator of FIG. 1.

FIG. 2 shows a hydraulic elevator pit 36 with a pit floor 37 and with a hydraulic cylinder 18 and piston 16 which are substantially the same as in FIG. 1 and which are contained within an elevator pit 36. The piston 16 extends vertically up out of the cylinder. The elevator shown in the FIG. 2 is a simple hydraulic elevator with a jack having a cylinder and a single piston located below the elevator car. The invention may be used, however, with other types of hydraulic elevators such as those using a jack with a cylinder and two pistons which telescope relative to one another. Also, the invention may be used with roped elevators, elevators containing multiple jacks located to the side of the car, etc. The invention may also be used in any environment that employs pressured hydraulic fluid which has a tendency potentially to leak.

Hydraulic fluid is contained in a reservoir tank 22, which is generally located outside of the pit 36, and selectively pumped by a pump motor 20 through a valve 52 into the cylinder 18 in order to raise the car 10. To lower the car, the motor 20 remains off, and the valve 52 opens a pathway from the cylinder 18 to the fluid reservoir tank 22. The weight of the car 10 pushes fluid back into the tank 22.

Due to the weight of the car 10, hydraulic fluid in the cylinder 18 is always pressurized. To try to prevent leakage, a bushing assembly or other type of seal (together referred to as a "bushing assembly 40*a*") is provided between the outer surface of the piston 16 and the inner surface of the cylinder 18. The piston 16 extends out of the cylinder 18 through a cylinder cap 54 having an opening for the piston 16.

The cylinder cap 54 includes a hollow interior. Fluid will eventually leak through the bushing and end up inside the cylinder cap 54. In accordance with the invention a tap 56 is inserted to communicate with the hollow interior of the cap 54. A drain line 58 connects the outlet of the tap 56 with a hydraulic fluid holding tank (i.e., "sump") 60, which is positioned at a height below the cylinder cap 54. Preferably, a vacuum vent check valve 62 is provided on the upper surface of the cylinder cap 54 and communicates with the interior of the cylinder cap 54 to allow air to enter to promote drainage. A second drain line 64 extends from the sump 60 to a self-priming pump 66, and a third drain line 70 extends from the pump 66 to a hydraulic recapturing holding tank 72. The holding tank 72 is preferably positioned at a height above the fluid reservoir tank 22 so that fluid in the recapturing holding tank 72 can be returned to the fluid reservoir tank 22 through a return line 74. An actuating valve 76 opens and closes to control the flow of fluid from the holding tank 72 back into the fluid reservoir tank 22.

As shown, piping is provided between the lower surface of the holding tank 72 and an inlet in the upper side of the fluid reservoir tank 22. The actuating valve 76 prevents fluid in the holding tank 72 from flowing into the fluid reservoir tank 22, except when desired.

Operation of the actuating valve is controlled by an electronic control panel 42*a*. The control panel 42*a* may encompass the control features of the control panel 42 for controlling basic elevator operation, or may be a separate control panel.

The holding tank 72 further includes a device, such as an electronic float 78, to measure the level of fluid in the holding tank 72. Output measurements from the float 78 are provided as electrical signals to the control panel 42*a*.

A sump level sensor 80 is also coupled to the sump 60 to monitor the level of fluid in the sump. The sump level sensor 80 provides a signal to the electronic control panel 42*a*. Similarly, the level of oil in the recapturing holding tank 72 is monitored, for example with an electronic float 78, and a signal is sent to the control panel 42*a* to be monitored.

The system preferably also includes a surveillance camera 84, such as an infra-red camera, whose lens 86 is mounted in a sealed fashion in an opening in the pit sidewall 81. The camera lens 86 faces the interior of the pit 36 and allows system personnel to remotely monitor conditions within the pit 36. The camera signal is also provided to the control panel 42*a*.

The control panel 42*a*, which can optionally be incorporated into the elevator control panel, includes a processor and memory (not shown). The processor is programmed to monitor the fluid level inside of the hydraulic sump holding tank 60 and inside of the hydraulic recapturing holding tank 72. Periodically, for example, when the fluid level reaches a predetermined height, the control panel 42*a* either turns on the self-priming pump 20 to move fluid from the sump 60 to the holding tank 72, or opens the actuating valve 76 to allow fluid in the holding tank 72 to flow back into the fluid reservoir tank 22.

The control panel 42*a* also includes electronic communication equipment for communicating with one or more remote computers. The method of communication can include any known method such as internet, satellite or land line telephone, cell, short text messaging, and so on. The processor operates the equipment in a predetermined manner, which includes sending alert signals to predetermined destinations in the event of a spill, a potential spill, or equipment failure. The processor is also programmed to accept predetermined commands from remote locations or from a computer located outside of the control panel, and thus can communicate with a computer operated by service personnel who are physically present as well as personnel who are located remotely. Such commands include operating the camera for remote viewing and monitoring. Preferably, the processor includes programming for encryption and security to allow access only to authorized personnel.

In the system described above, all of the mechanical and electrical equipment, i.e., the electronic control panel 42*a*, the fluid return pump 66, the fluid reserve tank 22, valves 52, 76, and pump motor 20 are located outside of the elevator pit 36. While the lens 86 of the monitoring camera needs to have access to the pit 36, it is sealed in the sidewall 81 of the pit, and thus isolated from the pit itself. Also, a protective lens may be provided on top of the camera lens 86 and sealed to the pit wall 81 for further isolation of the camera 84 from the interior of the pit 36.

The foregoing represent preferred embodiments of the invention. Various modifications will be evident to persons skilled in the art, and are intended to be within the scope of the invention, as set forth in the following claims.

The invention claimed is:

1. A system for use with a shaft with a pit which contains a hydraulic elevator or other equipment which uses pressurized hydraulic fluid and which can leak hydraulic fluid from a predetermined location within the pit, wherein said elevator or other equipment is supplied with hydraulic fluid from a fluid reservoir which is located outside of the pit, said system comprising:

a tap communicating with a space holding hydraulic fluid which has leaked from the elevator or other equipment, which tap is located inside the pit;

a fluid sump for temporarily holding fluid and which is located inside the pit;

a communication line coupled between said tap and said fluid sump for conducting fluid from said space to said fluid sump;

a pump located outside of the pit;

a fluid communication line between the fluid sump and the pump so that the pump is operable to pump fluid from the fluid sump to the pump;

a hydraulic fluid recapturing holding tank located outside the pit;

a second fluid communication line between the pump and the holding tank such that hydraulic fluid at the pump is pumped to the holding tank;

a third fluid communication line between the holding tank and an inlet into the fluid reservoir;

an actuating valve located in the third fluid communication line which selectively opens to allow hydraulic fluid in the holding tank to flow into fluid reservoir; and an electronic control panel located outside the pit which includes a processor programmed to interact with a remote computer to provide a remote user with information concerning operation of the system and to allow the remote user to monitor and control at least certain operations of the system, and which processor also controls operation of the pump and actuating valve.

2. The system according to claim 1, wherein the holding tank includes a sensor for detecting the level of fluid in the tank and generates signals to the control panel corresponding to the sensed level.

3. The system of claim 2, wherein the pit contains at least one pit sidewall, further comprising a camera for viewing the interior of the pit, which camera is located outside of the pit except for the camera lens which is directed through a sealed opening in the pit sidewall.

4. The system according to claim 2, wherein the sensor is an electronic float.

5. The system according to claim 2, wherein said control panel processor controls the actuating valve to periodically allow a portion of the fluid in the holding tank to be returned to the reservoir for recycling.

6. The system of claim 1, wherein the pit contains at least one pit sidewall, further comprising a camera for viewing the interior of the pit, which camera is located outside of the pit except for the camera lens which is directed through a sealed opening in the pit sidewall.

7. The system of claim 6, comprising a viewing lens covering the camera lens and being sealed relative to the pit sidewall.

8. The system of claim 1, further comprising a sump level sensor coupled to the fluid sump, the sump level sensor being configured to detect a level of hydraulic fluid in the fluid sump.

9. The system according to claim 8, wherein said control panel processor controls the pump to periodically allow fluid in the fluid sump to be pumped to the holding tank based on a predetermined electronic signal from the sump level sensor.

10. The system of claim 1, wherein the holding tank is positioned higher than the fluid reservoir.

11. The system of claim 1, wherein the fluid sump is positioned lower than the pump.

12. A system for use with a pit which has a pit floor and which contains a hydraulic elevator or other equipment which uses pressurized hydraulic fluid and which can leak hydraulic fluid from a predetermined location within the pit, wherein said elevator or other equipment is located outside of the pit and are supplied with hydraulic fluid from a fluid reservoir which is also located outside of the pit, said system comprising:

a tap communicating with a space holding fluid which has leaked from the elevator or other equipment, which tap is located inside the pit;

a fluid sump for holding hydraulic fluid which is located inside the pit;

a fluid communication line coupled between said tap and said fluid sump for allowing fluid to leak from said space to said sump;

an air line having one end in the fluid sump and extending out of the pit to a fluid sump level sensor;

a water sump located below the pit floor and including a second air line having one end in the water sump and extending out of the pit to a water level sensor; and an electronic control panel which includes a processor which receives signals from the water level sensor and fluid sump level sensor and is programmed to interact with a remote computer to provide a remote user with information concerning operation of the system including communicating the levels of fluid and water in the sumps.

13. A system for use with a shaft with a pit which contains a hydraulic elevator or other equipment which uses pressurized hydraulic fluid and which can leak hydraulic fluid from a predetermined location within the pit, wherein said elevator or other equipment is supplied with hydraulic fluid from a fluid reservoir which is located outside of the pit, said system comprising:

a tap communicating with a space holding hydraulic fluid which has leaked from the elevator or other equipment, which tap is located inside the pit;

a fluid sump for temporarily holding hydraulic fluid and which is located inside the pit;

a first fluid communication line coupled between said tap and said fluid sump for conducting fluid from said space to said fluid sump;

a second fluid communication line coupled between the fluid sump and the fluid reservoir;

a pump located outside of the pit and operable to selectively pump fluid from the fluid sump to the fluid reservoir over the second fluid communication line;

an actuating valve located along the second fluid communication line which selectively opens to allow hydraulic fluid from the fluid sump to flow into the fluid reservoir; and an electronic control panel located outside the pit which includes a processor programmed to interact with a remote computer to provide a remote user with information concerning operation of the system and to allow the remote user to monitor and control at least certain operations of the system, and which processor also controls operation of the pump and actuating valve.

14. The system of claim 13, wherein the second fluid communication line includes a hydraulic fluid recapturing holding tank located outside the pit and coupled between the fluid sump and the actuating valve, said holding tank being configured to store the hydraulic fluid from the fluid sump, and wherein the actuating valve selectively opens to allow the hydraulic fluid in the holding tank to flow into the fluid reservoir.

15. The system of claim 14, wherein the holding tank is positioned higher than the fluid reservoir.

16. The system of claim 13, wherein the fluid sump is positioned lower than the pump.

17. A system for use with a shaft having a pit which contains a hydraulic elevator or other equipment which uses pressurized hydraulic fluid and which can leak hydraulic fluid from a predetermined location within the pit, wherein said elevator or other equipment is supplied with hydraulic fluid from a fluid reservoir, said system comprising:

a tap communicating with a space holding hydraulic fluid which has leaked from the elevator or other equipment;

a fluid sump for temporarily holding leaked fluid;

a fluid communication line coupled between said tap and said fluid sump for allowing fluid to leak from said space to said fluid sump;

a pump;

a fluid communication line between the fluid sump and the pump so that the pump is operable to pump fluid from the fluid sump to the pump;

a hydraulic fluid recapturing holding tank;

a second fluid communication line between the pump and the holding tank such that hydraulic fluid at the pump is pumped to the holding tank;

a third fluid communication line between the holding tank and an inlet into the fluid reservoir;

an actuating valve located in the third fluid communication line which selectively opens to allow hydraulic fluid in the holding tank to flow into the fluid reservoir; and an electronic control panel which includes a processor programmed to interact with a remote computer to provide a remote user with information concerning operation of the system and to allow the remote user to monitor and control at least certain operations of the system, and which processor also controls operation of the pump and actuating valve.

* * * * *